US007846270B2

(12) United States Patent
Jerg et al.

(10) Patent No.: US 7,846,270 B2
(45) **Date of Patent: *Dec. 7, 2010**

(54) DISHWASHER HAVING A SORPTION DRYING DEVICE

(75) Inventors: Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 470 days.

This patent is subject to a terminal disclaimer.

(21) Appl. No.: 11/791,381

(22) PCT Filed: Dec. 6, 2005

(86) PCT No.: PCT/EP2005/056517

§ 371 (c)(1),
(2), (4) Date: May 23, 2007

(87) PCT Pub. No.: WO2006/061382

PCT Pub. Date: Jun. 15, 2006

(65) Prior Publication Data

US 2008/0295875 A1 Dec. 4, 2008

(30) Foreign Application Priority Data

Dec. 9, 2004 (DE) ..... 10 2004 059 425
Jan. 28, 2005 (DE) ..... 10 2005 004 094

(51) Int. Cl.
*B08B 3/00* (2006.01)

(52) U.S. Cl. ..... 134/58 D; 134/56 D; 134/57 D

(58) Field of Classification Search ..... 134/58 D, 134/56 D, 57 D
See application file for complete search history.

(56) References Cited

U.S. PATENT DOCUMENTS

| | | | | |
|---|---|---|---|---|
| 3,034,221 | A * | 5/1962 | Tuck et al. | 34/527 |
| 4,188,732 | A * | 2/1980 | Quayle | 34/570 |
| 5,660,195 | A * | 8/1997 | Taylor et al. | 134/58 D |
| 6,434,857 | B1 * | 8/2002 | Anderson et al. | 34/595 |
| 2005/0016010 | A1 * | 1/2005 | Pyo et al. | 34/62 |
| 2005/0109071 | A1 | 5/2005 | Dirnberger et al. | |

(Continued)

FOREIGN PATENT DOCUMENTS

CH 683819 A5 * 5/1994

(Continued)

OTHER PUBLICATIONS

Machine translation of the claims of DE-103 53 774.*

(Continued)

*Primary Examiner*—Michael Barr
*Assistant Examiner*—Charles W Kling
(74) *Attorney, Agent, or Firm*—James E. Howard; Andre Pallapies

(57) ABSTRACT

A dishwasher includes a washing container, devices for washing dishes by means of rinsing liquor, and a sorption drying device which is connected in an air-conducting manner to the washing container via an outlet of the washing container and an inlet of the washing container. The sorption drying device is provided with a sorption column encompassing reversibly dehydratable material. The outlet and the inlet of the washing container are connected to the sorption drying device without mounting an air duct there between.

13 Claims, 2 Drawing Sheets

U.S. PATENT DOCUMENTS

2006/0278257 A1 12/2006 Jerg et al.

FOREIGN PATENT DOCUMENTS

| | | | |
|---|---|---|---|
| DE | 2 016 831 | | 10/1971 |
| DE | 2016831 | * | 10/1971 |
| DE | 3626887 A | * | 2/1988 |
| DE | 40 12 579 | | 10/1991 |
| DE | 103 53 775 | | 2/2005 |
| DE | 10353774 A1 | * | 2/2005 |
| EP | 0 358 279 | | 3/1990 |
| WO | WO 2005053503 A1 | * | 6/2005 |

OTHER PUBLICATIONS

DE 20 16 831 English Translation.*
International Search Report PCT/EP2005/056517.

* cited by examiner

DISHWASHER HAVING A SORPTION DRYING DEVICE

The invention relates to a dishwasher with a washing container and devices for washing dishes by means of rinsing liquor and with a sorption drying device which is connected in an air-conducting manner to the washing container via an outlet of the washing container and an inlet of the washing container, and is provided with a sorption column encompassing reversible dehydratable material.

BACKGROUND OF THE INVENTION

As is known, conventional dishwashers perform a washing process whose programme sequence generally consists of at least one "Pre-wash" partial programme step, a "Clean" partial programme step, at least one "Intermediate wash" partial programme step, a "Clear wash" partial programme step and a "Dry" partial programme step. To increase the cleaning effect the rinsing fluid or rinsing liquor is heated before or during a partial programme step. The rinsing fluid is normally heated by means of electrical heating elements. Different drying systems are known for drying the items to be washed in a dishwasher.

DE 20 16 831 discloses, for example, a dishwasher of the type already mentioned in which the air is conducted from the washing container through a sealable opening in the wall of the washing container on reversibly dehydratable material, and from there to the outside through an opening. Desorption of the reversibly dehydratable material takes place during the non-operating phase of the device, the water vapour formed thereby being conducted to the outside through the opening. The dishwasher described is disadvantageous from the energy viewpoint because the regeneration of the reversibly dehydratable material takes place during a non-operating phase of the appliance, i.e. at a time when none of the partial programme steps already described is being carried out. A further disadvantage consists in the fact that the possibility of damage to the surrounding kitchen furniture cannot be ruled out as a result of the discharge of the water vapour formed during regeneration of the reversibly dehydratable material to the outside. In this case the regeneration is associated with an additional energy requirement which is additional to the energy required during the partial programme steps.

In order to minimise the energy expended during operation of a dishwasher, DE 103 53 774.0 of the applicant discloses a dishwasher with a washing container and devices for washing dishes by means of rinsing liquor which is provided with a sorption column which is connected in an air-conducting manner to the washing container and encompasses reversibly dehydratable material, where on the one hand the sorption column is used for drying the dishes and on the other hand the thermal energy utilised for desorption of the sorption column is used to heat the rinsing liquor and/or the dishes in the washing container, at least in part.

To solve the same problem DE 103 53 775.9 of the applicant proposes conducting air from a processing space and/or from ambient air through a sorption column and into the processing space for operating an appliance in the at least one "Dry" partial programme step, where the sorption column encompasses reversibly dehydratable material and moisture is extracted from the air during its through-passage.

Heating the items to be washed in the partial programme step preceding the "Dry" partial programme step is no longer normally necessary due to the use of reversibly dehydratable material with a hydroscopic property, e.g. zeolith. This allows a substantial saving in energy.

EP 0 358 279 B1 discloses a dishwasher with a closed drying system in which the air from the washing container circulates through a drying device that can be regenerated by heating and from this device back into the washing container. The drying device is assigned to the heater arranged outside the washing container for the rinsing liquor, this heater preferably being a geyser. The outlet of the washing container is located in the ceiling of the washing container, whilst the inlet is integrated in the washing tank of the washing container. The outlet of the washing container is connected to the sorption drying device by means of an air duct. Since the sorption drying device is assigned to the heater for the rinsing liquor it is arranged in a region underneath the rinsing tank.

SUMMARY OF THE INVENTION

A common feature of all the arrangements described above is that the integration of the sorption drying device in a dishwasher is only conceptually described. The object of this invention is therefore to provide a dishwasher in which a sorption drying device can be integrated easily and at low cost.

This object is achieved with a dishwasher having the features according to the exemplary embodiment described herein.

A dishwasher according to the invention, particularly a domestic dishwasher, has a washing container and devices for washing dishes by means of a rinsing liquor, as well as a sorption drying device which is connected in an air-conducting manner to the washing container via an outlet of the washing container and an inlet of the washing container, and which is provided with a sorption column encompassing reversibly dehydratable material. Provision is also made for connecting the outlet and inlet of the washing container to the sorption drying device without the intermediate mounting of an air duct. The advantage of this is that the space requirement is extremely low. This enables a dishwasher to be provided that is extremely simple and inexpensive to manufacture since it is possible to dispense with pipes or ducts that would have to be arranged in the dishwasher and since the sorption drying device can have a particularly compact design.

According to a preferred design the sorption drying device may be arranged in the bottom region of the dishwasher underneath a rinsing tank, the outlet and inlet of the washing container being arranged in the bottom region. Since sufficient space is normally provided for functional elements of the dishwasher underneath the rinsing tank, the sorption drying device can be integrated extremely easily in existing design and production processes.

According to a further suitable design the outlet and/or inlet is/are provided with a passive means for sealing against penetrating water. In the simplest case this may be a cover over the outlet and/or inlet which is preferably designed so that at the same time the direction of the air flow is established to achieve the best possible turbulence of the air in the washing container for effective moisture absorption.

In an alternative design the outlet and/or the inlet may be provided with active sealing means. The sealing means may be designed, for example, so that it can be actuated by applying a voltage. The sealing means may therefore be designed so that it is motor or hydraulically driven. It is particularly advantageous here if voltage is also applied to the sealing means when voltage is applied to the fan, enabling the sealing means to open to provide air circulation to the sorption drying device. Here the inlet and outlet need only be open during the regeneration phase of the sorption column and during the "Dry" partial programme step. During the other partial programme steps the sealing means provide such sealing to prevent spray water from penetrating the sorption drying device provided with electrical functional elements.

In a further suitable design the sealing means may also be actuated by a temperature-sensitive memory metal. Here the sealing means is not actuated electrically but on the basis of the temperatures prevailing during different partial programme steps.

According to a further design the sorption column is used for drying the dishes on the one hand, and the thermal energy utilised for desorption of the sorption column is used to heat the rinsing liquor and/or the items to be washed present in the washing container. In terms of its operating principle the dishwasher may be designed as described in DE 103 53 774.0 of the applicant, the content of which is incorporated in this application, if appropriate. The machine described here differs in terms of the arrangement of the sorption drying device.

According to a preferred feature, air is conducted from the washing container and/or from the ambient air during a partial programme step with rinsing liquor to be heated, preferably during the "Clean" and/or "Pre-wash" and/or the "Clear wash" partial programme step through the sorption column and back into the washing container.

An electrical heating element is suitably arranged for desorption of the reversibly dehydratable material and for heating the rinsing liquor and/or the items to be washed. This element is preferably arranged in the reversibly dehydratable material.

BRIEF DESCRIPTION OF THE DRAWINGS

The invention is explained in further detail in the following with reference to FIGS. 1 and 2, which illustrate exemplary embodiments of a dishwasher according to the invention.

DETAILED DESCRIPTION OF THE EXEMPLARY EMBODIMENTS OF THE PRESENT INVENTION

Figure 1:
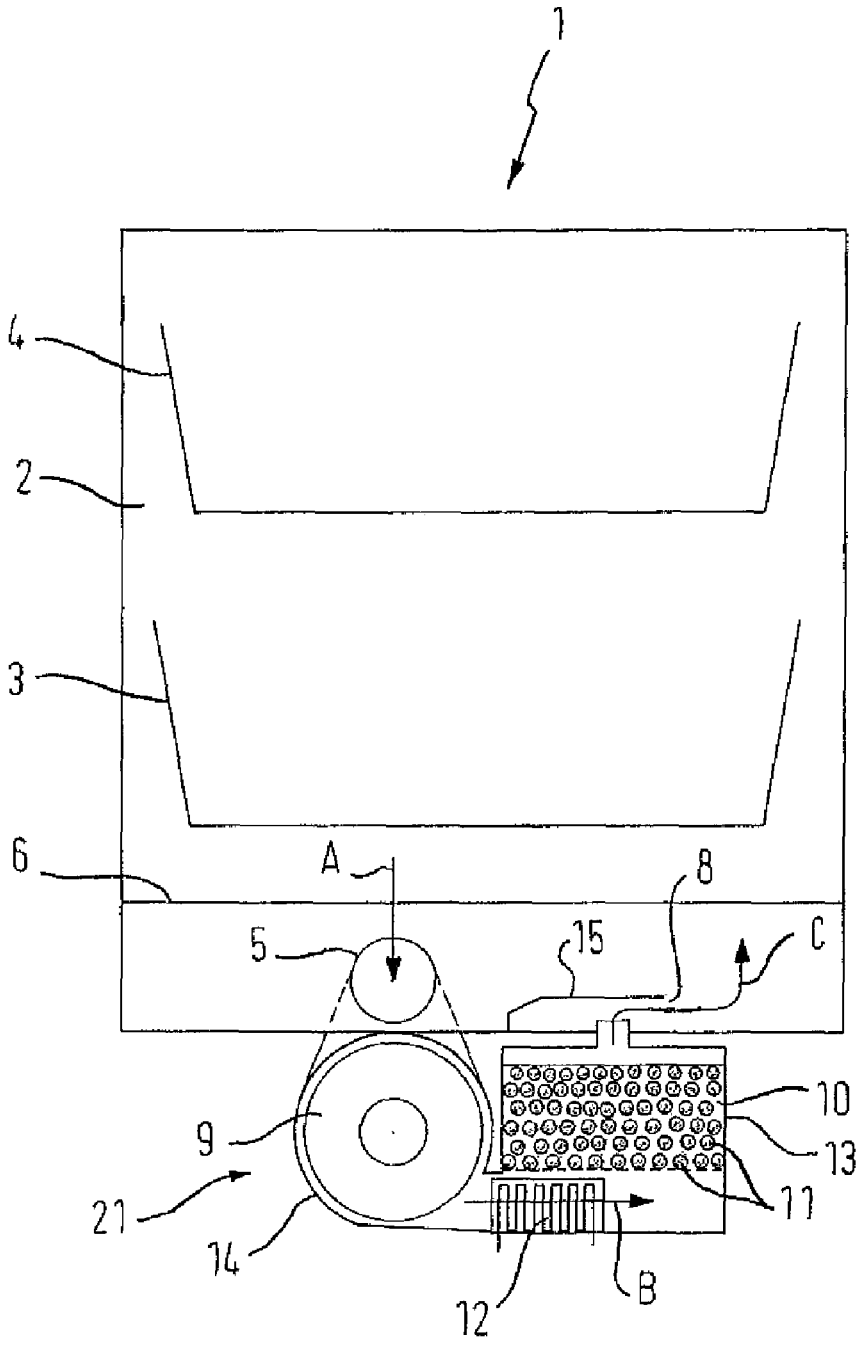
Figure 2:
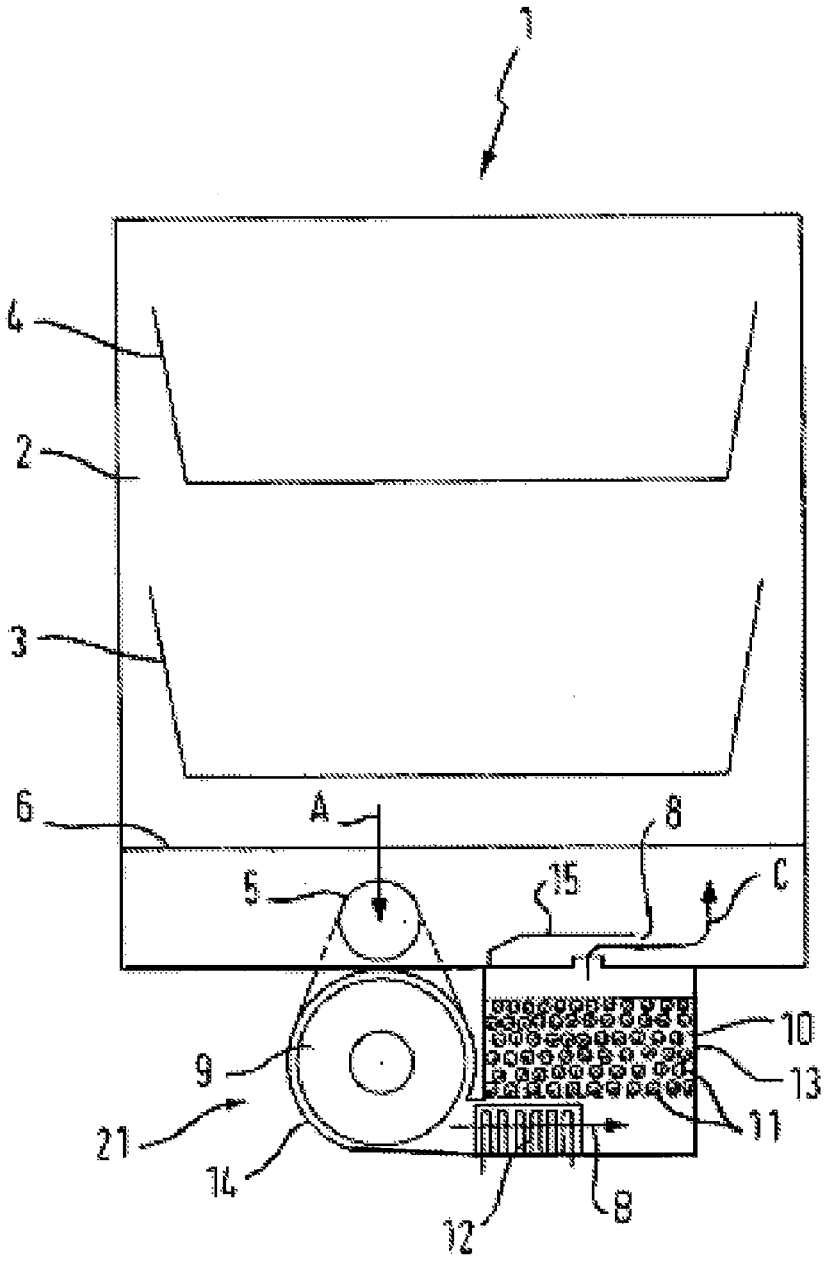

FIG. 1 shows, in a diagrammatic representation, a dishwasher 1 of the invention according to a first variant with a washing container 2, in which are arranged crockery baskets 3, 4 for the storing of items to be washed, not shown. The dishwasher according to the invention can in principle be constructed as described in DE 103 53 774 and/or DE 103 53 775 of the applicant, the contents of which are incorporated in this application, where appropriate. Dishwasher 1 is provided with a sorption column 10 which is connected in an air-conducting manner to washing container 2 and encompasses reversibly dehydratable material 11, e.g. zeolith, sorption column 10 being used on the one hand for drying and on the other hand for heating air passed through. Washing container 2 has an outlet 5 which is arranged in the exemplary embodiment described in rinsing tank 6, which outlet is connected directly to a sorption drying device 21 arranged underneath the rinsing tank, and has an inlet 8 from sorption drying device 21 which is also arranged in the exemplary embodiment described in rinsing tank 6. In addition to sorption column 10 sorption drying device 21 also has a fan 9 and an electrical heating element 12, a housing 14 of the fan and a housing 13 of sorption column 10 being formed integrally underneath rinsing tank 6 of dishwasher 1. The passage of air through sorption drying device 21 is denoted by arrows A, B and C. The drying process itself takes place as described in DE 103 53 774 and/or DE 103 53 775 of the applicant.

To prevent penetration of spray water in sorption drying device 21 and the electrical functional parts (fan 9, heating element 12) during a partial programme step to which items to be washed in washing container 2 are subjected, outlet 5 is provided with a sealing means (not shown in detail in the figure) for reliably preventing penetration of water. Inlet 8 in the figure is suitably provided, for example, with a passive sealing means 15, designed in the exemplary embodiment as a cover with a flow function. A passive sealing means can generally be represented by any suitably designed cover.

Both outlet 5 and inlet 8 could be provided with a (controllable) actively actuated sealing means according to a variant, not shown. An active sealing means may be formed by a cover, slide valve or the like having an opening and closing function, the opening and closing position preferably being coupled to the operation of sorption drying device 21, more precisely to the operation of its fan 9 and/or electrical heating element 12. The active sealing means can therefore allow unobstructed sucking in or blowing out of air during the operation of the fan, e.g. during the "Dry" partial programme step, and reliably seal the access or accesses to the sorption drying device against the penetration of rinsing liquor when the fan is switched off. The active sealing means could be actuated by a motor and/or hydraulically, the actuation taking place as a function of the operation of the sorption drying device. Alternatively the use of a memory metal would also be conceivable, which metal could be brought into an opening or closing position during different partial programme steps according to the varying temperatures.

The advantage of the dishwasher according to the invention is that it can be produced simply and at low cost because the laying and integration of air ducts can be dispensed with.

According to this invention a dishwasher is provided which, from the economic point of view, can be produced at low cost and can be cleaned and dried efficiently with the items to be washed present in the washing container, with the possibility of minimising the associated energy expenditure.

LIST OF REFERENCE SYMBOLS

1 Dishwasher
2 Washing container
3 Crockery basket
4 Crockery basket
5 Outlet
6 Rinsing tank
8 Inlet
9 Fan
10 Sorption column
11 Reversibly dehydratable material
12 Electrical heating element
13 Housing
14 Housing
15 Sealing means
21 Sorption drying device
A,B,C Air passage

The invention claimed is:

1. A dishwashing machine comprising: a washing container having a washing container exit outlet and a washing container entrance inlet;

at least one device for washing crockery using a washing solution; and a sorption drying device communicated with the washing container for the passage of air between the sorption drying device and the washing container, the sorption drying device having a housing containing reversibly dehydratable material that operates to withdraw moisture from the air during the passage of the air through the sorption drying device, the air exiting from the washing container via the washing container exit outlet, thereafter flowing directly into the housing of the sorption drying device and along a flow path through the sorption drying device, and eventually exiting the sorption drying device to return to the washing container via the washing container entrance inlet, wherein the washing container exit outlet is directly connected to the housing of the sorption drying device without an air duct disposed therebetween for the passage of the air directly between the washing container and the housing of the sorption drying device, and the washing container entrance inlet is directly connected to the housing of the sorption drying device without an air duct disposed therebetween for the passage of the air directly between the housing of the sorption drying device and the washing container, wherein the sorption drying device is arranged in a bottom region of the dishwasher underneath the washing container, and the washing container exit outlet and the washing container entrance inlet are arranged in the bottom region of the washing container.

2. The dishwasher according to claim 1, wherein the washing container exit outlet and the washing container entrance inlet are provided with a passive sealing means against penetrating water.

3. The dishwasher according to claim 1, wherein the washing container exit outlet and the washing container entrance inlet are provided with an active sealing means.

4. The dishwasher according to claim 3, wherein the active sealing means is actuated by the application of a voltage.

5. The dishwasher according to claim 4, wherein the sorption drying device includes a fan, and wherein voltage is applied to the active sealing means when a voltage is applied to the fan.

6. The dishwasher according to claim 4, wherein the active sealing means is actuated by a temperature-sensitive memory metal.

7. The dishwasher according to claim 1, wherein, on the one hand the sorption drying device is used to dry crockery being handled by the dishwasher and, on the other hand, thermal energy utilized for desorption of the sorption drying device is used to at least partially heat at least one of the washing solution in the washing compartment and crockery.

8. The dishwasher according to claim 7, wherein air is conducted from the washing container and /or ambient air during a partial programme step with rinsing solution to be heated, preferably during the "Clean" and/or "Pre-wash" and/or "Clear wash" partial programme step through the sorption drying device and back into the washing container.

9. The dishwasher according to claim 7, wherein an electrical heating element is arranged for desorption of the reversibly dehydratable material and for heating the washing solution and/or the items to be washed.

10. The dishwasher according to claim 9, wherein the heating element is arranged in the reversibly dehydratable material.

11. A dishwashing machine comprising:

a washing container having a washing container exit outlet and a washing container entrance inlet;

at least one device for washing crockery using a washing solution; and a sorption drying device having a housing including a sorption column of reversibly dehydratable material that operates to withdraw moisture from air during the passage of the air through the housing of the sorption drying device, a fan for passing the air through the housing of the sorption drying device, and a heating element, wherein the housing of the sorption drying device is directly connected to the washing container exit outlet and the washing container entrance inlet of the washing container without an intermediate air duct connecting the sorption drying device and the washing container for the passage of air between the sorption drying device and the washing container, wherein air exiting from the washing container via the washing container exit outlet flows directly into the housing of the sorption drying device, thereafter flowing along a flow path past the fan and heating element and through the sorption column of reversibly dehydratable material, and eventually exiting the housing of the sorption drying device and entering directly from the housing into the washing container entrance inlet of the washing container, wherein the sorption drying device is arranged underneath the washing container, and wherein the washing container exit outlet and the washing container entrance inlet are arranged in a bottom region of the washing container.

12. The dishwasher according to claim 11, wherein the washing container exit outlet and washing container entrance inlet include a passive sealing device against penetrating water.

13. The dishwasher according to claim 11, wherein the washing container exit outlet and washing container entrance inlet include an active sealing device.

* * * * *